United States Patent [19]

Provencher et al.

[11] Patent Number: 4,992,241

[45] Date of Patent: Feb. 12, 1991

[54] RECYCLING OF METAL MATRIX COMPOSITES

[75] Inventors: Robert Provencher, Jonquiere; Gaston Riverin, Chicoutimi, both of Canada

[73] Assignee: Alcan International Limited, Montreal, Canada

[21] Appl. No.: 493,987

[22] Filed: Mar. 15, 1990

[51] Int. Cl.[5] ..... C22C 21/00; C22C 29/00

[52] U.S. Cl. ..... 420/528; 75/680; 75/681

[58] Field of Search ..... 75/680, 681, 687; 420/528

[56] References Cited

U.S. PATENT DOCUMENTS

| | | | |
|---|---|---|---|
| 3,743,263 | 7/1973 | Szekely | 266/34 A |
| 3,839,019 | 10/1974 | Bruno et al. | 75/681 |
| 4,191,559 | 3/1980 | Van Linden | 75/10.39 |
| 4,634,105 | 1/1987 | Withers | 266/217 |
| 4,761,207 | 8/1988 | Stewart, Jr. | 75/10.39 |
| 4,786,467 | 11/1988 | Skibo et al. | 420/528 |
| 4,808,372 | 2/1989 | Koczak et al. | 420/528 |
| 4,812,289 | 3/1989 | Alexander | 420/528 |

*Primary Examiner*—Melvyn J. Andrews
*Attorney, Agent, or Firm*—Cooper & Dunham

[57] ABSTRACT

A process is described for recycling scrap aluminum-matrix composites, e.g. gates and risers from a casting operation. A melt of the scrap composite is provided in a treatment vessel by heating at a temperature of 720°-750° C., such as to avoid unwanted stirring and contamination of the melt. While mixing with the impeller, a gas is injected through a gas outlet beneath the surface of the melt and near the rotating impeller. This melt is mixed with a vaned rotor impeller such that no vortex is formed and oxide film is not drawn into the melt. This treatment gas comprises a mixture of a major proportion of an inert gas and a minor proportion of reactive gas. The gas injection is continued only until small gas bubbles have been well distributed through the melt but before the gas causes the reinforcing parties to start rising to the surface. After the gas is stopped, the melt is allowed to rest for a period of time at the reaction temperature of 720°-750° C. with at least periodic gentle mixing to keep the reinforcing particles distributed evenly throughout the melt. During this treatment, hydrogen is removed from the melt by diffusion into the gas bubbles and the other non-metallic impurities are attached to the bubbles and lifted into a dross layer on the surface by flotation, while the reinforcing particles remain dispersed in the melt. The dross layer containing oxide films and other impurities is skimmed from the surface of the melt, leaving a purified aluminum matrix composite. This composite can then be cast in the usual manner.

19 Claims, 1 Drawing Sheet

RECYCLING OF METAL MATRIX COMPOSITES

BACKGROUND OF THE INVENTION

This invention relates to recycling of metal matrix composites and more particularly, to a process for removing contaminants from scrap metal matrix composites, such as gates and risers from the casting of aluminum matrix composites.

By scrap metal matrix composites is meant material in which the degree of wetting of the particulate reinforcing media by the aluminum matrix remains unimpaired. Such otherwise sound material may be contaminated by, e.g. oxide film inclusions which decrease the fluidity of remelted scrap material and the mechanical properties of the product cast therefrom.

Aluminum matrix composites are widely used where high strengths and other enhanced properties are required in casting. As materials for reinforcing the aluminum matrix, a variety of non-metallic particulates are typically used, e.g. silicon carbide, alumina, etc. These aluminum matrix composites may contain hydrogen in gaseous form as well as oxide inclusions, aluminum carbide, etc. and the presence of these contaminants represents an ongoing problem for foundries involved in casting of such composites. Such contaminants have detrimental effects on the fluidity of molten composites and mechanical properties of the cast products.

A particularly troublesome species of these contaminants are oxide films or inclusions. These oxide films have approximately the same density as an aluminum matrix composite melt because of the agglomeration of particulates on the oxide films. The presence of oxide films in the melt has a very detrimental effect on the ultimate tensile strength and elongation of the cast product and, furthermore, these oxide films drastically affect the fluidity of the melt, which is one of the most important physical properties of a casting alloy.

The injection of an inert gas or inert-reactive gas mixtures into molten metal is a commonly used technique for the removal of the above contaminants. Such systems are described in Bruno et al, U.S. Pat. Nos. 3,839,019, Szekely, 3,743,263, Withers et al, 4,634,105 etc. These prior systems are based upon injecting gas in the form of small discrete bubbles and these small bubbles are intended to float or dewet a substantial proportion of any solid particulates contained in the molten metal and remove other contaminants, such as dissolved hydrogen, in the melt. In the case of composites, the gas bubbles end up removing the composite reinforcing particles thereby defeating the purpose for aluminum matrix composites.

Various attempts have been made to solve the problem of removing contaminants from aluminum matrix composites while leaving the reinforcing particles in place. Such attempts have included trying to carefully control the mixing of the molten composite such that oxide inclusions are not generated and the gas bubbles have been introduced as large discrete bubbles which were reasonably successful in avoiding any substantial flotation or dewetting of the reinforcing particles such that they rose to the surface of the melt. However, the large gas bubbles tended to burst at the surface of the melt and this resulted in oxide films or inclusions being drawn back into the melt. This had a disastrous effect on the fluidity of the melt, changing it to a thick paste consistency.

It is the object of the present invention to provide a process for selectively removing unwanted contaminants from aluminum matrix composites without also removing the particulate materials added as reinforcing agents and without introducing oxide films or inclusions into the composite, e.g. for recycling otherwise sound scrap material, such as foundry gates and risers, to restore fluidity and mechanical properties.

SUMMARY OF THE INVENTION

According to the present invention, it has been found that the above object can be achieved by a very special combination of the previously known processing conditions for removing contaminants. This new technique involves providing a treatment vessel for holding a melt of the aluminum matrix composite to be recycled. Heating means are provided for heating the contents of the vessel to a temperature in the range of 720°–750° C. and it is essential that this heating be conducted such as to avoid unwanted stirring and contamination of the melt. Mixing of the melt is carried out by means of a power driven vaned rotary impeller in such a manner that no vortex is formed and oxide films or inclusions are not drawn into the melt. While mixing with the impeller, a gas is injected through a gas outlet beneath the surface of the melt and near the rotating impeller. This treatment gas comprises a mixture of a major proportion of an inert gas and a minor proportion of reactive gas. The gas injection is continued only until small gas bubbles have been well distributed through the melt but before the gas causes the reinforcing particles to start rising to the surface. After the gas is stopped, the melt is allowed to rest for a period of time at the reaction temperature of 720°–750° C. with at least periodic gentle mixing to keep the reinforcing particles distributed evenly throughout the melt. During this treatment, hydrogen is removed from the melt by diffusion into the gas bubbles and the other non-metallic impurities are attached to the bubbles and lifted into a dross layer on the surface by flotation, while the reinforcing particles remain dispersed in the melt. The dross layer containing oxide films and other inpurities is skimmed from the surface of the melt, leaving a purified aluminum matrix composite. This composite can then be cast in the usual manner.

It is essential according to the present invention that the mixing be carried out such that a vortex is not formed and surface turbulence is avoided. To achieve this while providing sufficient shearing action during mixing to create and distribute small bubbles, it is particularly advantageous to position the axis of the mixing impeller in a location offset from the central axis of the treatment vessel. Generally, the mixing impeller is located with its axis about one half of the distance between the central axis and the side wall of the vessel. It is also possible to provide baffles in the melt to prevent vortex formation.

The treatment gas which is used in the process of this invention must include both an inert gas and a reactive gas. If an inert gas is used alone, there are severe problems with oxide film formation in the melt and resultant loss of fluidity and mechanical properties. The treatment gas must be free of moisture and as the inert gas component, any gas may be used which is substantially non-reactive toward liquid aluminum at reaction temperatures, e.g. argon or nitrogen. However, argon is preferred. The reactive component may be chlorine, a gaseous fluoride compound or a mixture of the two, with $SF_6$ being particularly preferred. The proportion of reactive gas to inert gas must be rather carefully controlled in order to cause dewetting of contaminant particles while avoiding dewetting of the reinforcing particles. When the reactive gas is chlorine, it is preferably used in a proportion of less than 10% by volume, typically in the range of 2–10% by volume. When $SF_6$ is used as the reactive gas, it is preferably present in the gas mixture in an amount of less than 20% by volume and typically 5–20% by volume.

For efficient operation, treatment gas flow rates in the range of 2–6 l/min. are preferably used for a 300 kg melt.

It is important that the gas be injected well beneath the surface of the melt and it should also be injected close to the impeller so that there is a strong shearing action to break up the gas into small well distributed bubbles. The gas may be injected through a hollow rotor with an outlet for the gas at the bottom end of the impeller rotor or the gas may be injected by being discharged through an opening in the rotor in the vicinity of the impeller vanes. Alternatively, a separate injection lance may be used having an outlet close to the impeller vanes.

The mixing device is preferably made from graphite, silicon carbide or a ceramic material which is inert to the molten metal. It comprises an impeller consisting of a central hub portion with radially projecting vanes set to provide sustantial shearing action. They are preferably inclined to the horizontal at an angle of about 15° to 45°. The ratio of the impeller diameter to the diameter of the vessel is preferably about 1:2.5 to 1:4 and the impeller blades preferably have an axial height: diameter ratio of about 1:2 to 1:4. The impeller typically has about 4–6vanes.

The impeller must be rotated at a speed which is less than that at which a vortex would be generated. This is typically at a rate of about 100–250 rpm. Speeds up to 250 rpm without vortex formation are made possible by the offset of the axis of the impeller from the central axis of the vessel. Alternatively, one or more baffles may be provided on the inner wall of the vessel.

The temperature of the melt in the treatment vessel must be carefully controlled and the heating itself must be carefully carried out. Electric induction heaters should be avoided to avoid inductive stirring and also, any direct contact should be avoided between combustion products of gas or oil and the melt. Heating is preferably done by electric heating elements in or surrounding the vessel wall, or heating elements may be positioned in the roof of the treatment vessel. It is also possible to use a fuel fired burner located outside the vessel for heating through the vessel wall.

It is essential that the temperature of the melt be maintained no higher than 750° C. At temperatures above 750° C., there is an increase in the rate of reaction of aluminum with the silicon carbide reinforcing particles to form aluminum carbide, while releasing silicon into the melt. This is very detrimental to the properties of the composite. With the temperature carefully controlled, the treatment gas is injected for a limited period of time in the order of about 5 to 20 minutes. It should be discontinued when the gas bubbles have been well distributed throughout the entire melt. However, the melt with the distributed gas bubbles should remain in the vessel at the treatment temperature for a holding time during which the process is completed. This holding time is typically about 10 to 45 minutes and during that time the small bubbles travel to the surface bringing with them dissolved hydrogen and the contaminants other than the reinforcing particles. During the holding time, there is a tendency for the reinforcing particles to settle. This may cause the bottom temperature in the vessel to rise above 750° C. and in order to avoid this happening, the melt is given an occasional gentle mixing during the holding period such that the reinforcing particles are kept well distributed throughout the melt. This can be done by moving the rotor to a location at or near the centre of the vessel and keeping the speed of the rotor blow 50 rpm.

It is advantageous to blanket the surface of the melt with an inert gas, such as argon, to protect the melt from atmospheric oxygen. At the end of the treatment, the dross formed on the surface of the melt is skimmed off, leaving in the vessel an aluminum matrix composite substantially free from contaminants.

The process of the invention is a great value to foundries for casting aluminum matrix composites. For instance, in casting with permanent moulds, recovery loss of the incoming casting material may be as much as 40–70% during a normal procedure of casting. A large part of this loss is in the form of gates and risers removed from the finished castings and it has not previously been possible to remelt these without contaminating the melt with oxide film inclusion, thereby leading to a loss of mechanical strength and fluidity. Thus, the process of this invention greatly improves the economy of the process by decreasing the amount of waste in the casting of aluminum matrix composites. It is also possible with the process of this invention to hold a clarified aluminum matrix composite in molten form between casting procedures. The melt can be stored for four times the normal storage time without deterioration.

BRIEF DESCRIPTION OF THE DRAWINGS

The invention is illustrated by way of example with reference to the drawings in which.

Figure 1:
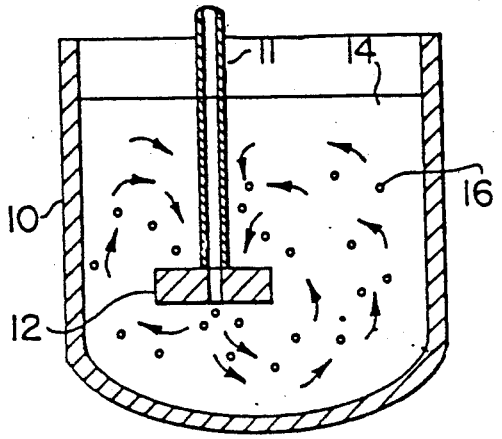
FIG. 1 is a vertical section of one form of treatment vessel for carrying out the invention.
Figure 2:
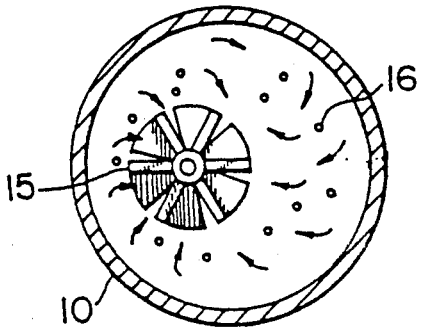
FIG. 2 is a horizontal section of the device of FIG. 1.

A suitable arrangement for carrying out the invention is depicted in FIGS. 1 and 2 wherein a vessel 10 is provided which may conveniently be a furnace used for melting aluminum foundry alloys for sand or gravity die casting. The vessel does not require a cover, although one may be used, but a blanket of inert gas on top of the molten metal is desirable to avoid contact between molten metal contained in the vessel and the atmosphere. The vessel is preferably circular in cross section and typically has a diameter of about 65–75 cm. The vessel contains a molten metal matrix composite 14 and the depth of the melt is typically about equal to the diameter of the vessel.

Extending down into the molten composite is a rotatable mixer consisting of a hollow rotatable drive shaft 11 with an impeller 12 with radially projecting vanes 15 at the bottom thereof. The impeller has a diameter of about 20 cm across the vanes 15 with each vane having an axial height of about 7 cm. The impeller shown has six vanes 15 set at an angle of 30° to the horizontal.

Figure 3:
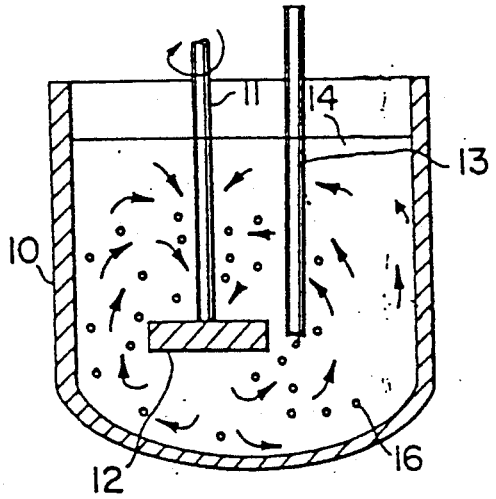
FIG. 3 is a vertical section of a further embodiment of the device of the invention.

FIG. 3 shows a second embodiment with a lance 13 consisting of a pipe extending down into the molten metal with an outlet hole at the bottom end thereof. This outlet is placed close to the impeller 12 so that the emerging gas will be broken down into very small and uniform bubbles.

In a typical operation, with the impeller rotating at a speed of about 150–250 rpm, treatment gas is injected into the melt at a rate of 6 l/min. This is continued for 10 minutes after which the flow of gas is stopped. The impeller is also stopped and, if desired, moved to the centre of the vessel. The mixture is then left in the treatment vessel for an additional time of approximately 45 minutes to complete the recycling process. During this time, at equally spaced intervals of about 10 minutes, the impeller is turned on for about 5 minutes to keep the reinforcing particles well mixing through the melt.

At the end of the treatment, the dross formed is skimmed from the surface of the melt, leaving in the vessel an aluminum matrix composite substantially free of contaminants.

Certain preferred features of this invention are illustrated by the following examples.

EXAMPLE 1

The device described in FIGS. 1 and 2 was used to conduct a series of experiments in which a 300 kg charge of aluminum matrix composite was added to vessel 10. The molten composite was an aluminum alloy having the Aluminum Association designation A356 containing 15% by volume of silicon carbide particles (DURALCAN ® F3A.15S). The treatment gas used was argon gas containing 15% by volume of $SF_6$ and this was introduced into the melt at a rate of 6 l/m. The molten composite was maintained at a temperature of 750° C.

The treatment gas was injected for a period of 10 minutes while continuously mixing the melt with the impeller operating at a rate of 170 rpm. Then, the flow of treatment gas was stopped and the impeller was turned off. The melt was held at 750° C. for 45 minutes and the impeller was turned on for 5 minutes at 10 minute intervals.

Two different tests were carried out using above procedure, the first with A356 15% SiC ingots which were remelted in the treatment vessel and the second was a mixture of the A356 15% SiC with 25% by weight of scrap material consisting of gates and risers from a foundry. The gates and risers were placed on top of the A356 15% SiC ingots for remelting.

The molten composites obtained after the above treatment were tested for fluidity by pouring the molten composites into a fluidity spiral mould and measuring the length of the molten metal. The following results were obtained.

TABLE I

| Alloy | Spiral Length (in.) |
|---|---|
| A356-0% SiC (Control) | 56 ($\sigma$ = 5) |
| A356-15% SiC Ingot remelt | 30 ± 3 |
| 10 min. treat with 45 min. hold | 34 ± 3 |
| A356-15% SiC (25% gates & risers) Remelt | 18 ± 3 |
| 10 min. gas treat. with 45 min. hold | 32 ± 3 |

We claim:

1. A process for recycling an aluminum matrix composite containing solid reinforcing particles, comprising the steps of:

(a) providing a melt of the aluminum matrix composite in a treatment vessel, (b) heating the melt in said vessel to maintain a temperature in the range of 720–750° C., said heating being conducted such as to avoid unwanted stirring and contamination of the melt, (c) mixing the melt with a vaned rotary impeller such that no vortex is formed and oxide film is not drawn into the melt, (d) treating the melt while mixing by injecting a gas through a gas outlet beneath the surface of the melt and near the rotating impeller, said gas comprising a mixture of a major proportion of an inert gas and a minor proportion of a reactive gas, terminating the gas injection after small gas bubbles have been well distributed throughout the melt and thereafter allowing the melt to rest at the temperature of 720–750° C. with at least periodic gentle mixing to keep the reinforcing particles distributed throughout the melt, whereby hydrogen is removed from the melt by diffusion into the gas bubbles and other non-metallic contaminants are lifted into a dross layer by flotation, while the reinforcing particles remain dispersed in the melt, and (e) skimming the dross layer containing oxide films and other contaminants from the surface of the melt, leaving a purified aluminum matrix composite.

2. A process according to claim 1 wherein the purified aluminum matrix composite is cast.

3. A process according to claim 1 wherein the axis of the mixing impeller is off-set from the central axis of the treatment vessel.

4. A process according to claim 3 wherein the mixing impeller is located with the axis thereof about halfway between the central axis and a side wall of the vessel.

5. A process according to claim 1 wherein at least one baffle is provided on the inner wall of the treatment vessel.

6. A process according to claim 1 wherein the inert gas is argon and the reactive gas is selected from chlorine, a gaseous fluoride compound and mixtures thereof.

7. A process according to claim 6 wherein the reactive gas is $SF_6$ or chlorine.

8. A process according to claim 1 wherein the treatment gas comprises 95–80 vol% argon and 5–20 vol% $SF_6$.

9. A process according to claim 6 wherein the treatment gas comprises 98–90 vol% argon and 2–10 vol% chlorine.

10. A process according to claim 6 wherein the gas injection is continued for about 5–20 minutes followed by a holding time of at least 10 minutes.

11. A process according to claim 10 wherein the holding time is about 25–45 minutes.

12. A process according to claim 3 wherein the impeller blades are set at an angle in the range of about 15°–45° relative to the horizontal.

13. A process according to claim 12 wherein the impeller is rotated at a rate of 100–250 r.p.m.

14. A process according to claim 13 wherein the ratio of the impeller diameter to the diameter of the vessel is about 1:2.5 to 1:4.

15. A process according to claim 14 wherein the impeller blades have an axial height:diameter ratio of about 1:2 to 1:4.

16. A process according to claim 6 wherein the initial melt is prepared by placing foundry scrap of aluminum matrix composite in the vessel and melting.

17. A process according to claim 6 wherein the initial melt is prepared by placing virgin ingots of aluminum matrix composite in the bottom of the vessel and placing foundry scrap of aluminum matrix composite on top and melting.

18. A process according to claim 7 wherein the heating of the vessel is carried out by means of electric heating elements surrounding the vessel wall or in the roof of the vessel.

19. A process according to claim 7 wherein the heating of the vessel is carried out by means of a fuel fired burner located outside the vessel and heating through the vessel wall.

* * * * *